US005235747A

United States Patent [19]

Leino et al.

[11] Patent Number: 5,235,747

[45] Date of Patent: Aug. 17, 1993

[54] METHOD OF MANUFACTURE OF A ROLL FOR USE IN PAPER PRODUCTION

[75] Inventors: Jorma Leino; Juhani Vestola; Jukka Salo; Ari Telama, all of Jyväskylä, Finland

[73] Assignee: Valmet Paper Machinery Inc., Finland

[21] Appl. No.: 844,837

[22] Filed: Mar. 3, 1992

Related U.S. Application Data

[62] Division of Ser. No. 599,628, Oct. 18, 1990, Pat. No. 5,111,567.

[30] Foreign Application Priority Data

Oct. 27, 1989 [FI] Finland ..... 895104

[51] Int. Cl.[5] ..... B21B 31/08

[52] U.S. Cl. ..... 29/895.32

[58] Field of Search ..... 29/110, 132, 895.3, 29/895.32; 427/217; 428/570, 937; 162/357; 100/155 R; 228/208, 209; 492/53, 54

[56] References Cited

U.S. PATENT DOCUMENTS

| | | | |
|---|---|---|---|
| 4,447,501 | 5/1984 | Shigeru et al. | 428/570 |
| 4,609,577 | 9/1986 | Long | 428/683 |
| 4,793,041 | 12/1988 | Jenkins et al. | 29/132 X |
| 4,796,342 | 1/1989 | Miihkinen | 29/132 |
| 4,912,835 | 4/1990 | Harada et al. | 29/132 |
| 4,991,501 | 2/1991 | Yokohama et al. | 29/132 X |
| 5,070,587 | 12/1991 | Nakahira et al. | 29/132 |

*Primary Examiner*—Mark Rosenbaum
*Assistant Examiner*—S. Thomas Hughes
*Attorney, Agent, or Firm*—Steinberg & Raskin

[57] ABSTRACT

The invention concerns a roll for use in the production of paper, in particular a center roll in a press section of a paper making machine, with which the web is in direct contact and from which the web is detached. In the invention, a composite structure has been formed onto the cylinder mantle of the roll. According to the invention, the roll face is provided with a surface layer which protects the roll from wear and which provides good properties for detaching of the web, this surface layer being formed by thermal spraying of a powder wherein metal and ceramic phases are in the same powder particle. The roll face is additionally provided with a dense layer for protection against corrosion, which layer is made of stainless steel whose chromium content is 10 to 29% and which layer is placed between the surface layer and the roll mantle. The function of the layer for protection from corrosion is to protect the roll mantle from corrosion and to promote the adhesion of the surface coating to the roll. The invention also concerns a method for the manufacture of the roll.

20 Claims, No Drawings

METHOD OF MANUFACTURE OF A ROLL FOR USE IN PAPER PRODUCTION

This is a division, of application Ser. No. 07/599,628, filed Oct. 18, 1990, now U.S. Pat. No. 5,111,567.

BACKGROUND OF THE INVENTION

The invention concerns a roll used in the production of paper, in particular a center roll in a press section of a paper making machine, with which the web is in direct contact and from which the web is detached, a composite structure being formed on the cylinder mantle of the roll.

The invention also concerns a method for the manufacture of a roll in accordance with the invention.

As is well known, in the press section of a paper making machine, a rock roll is used, which is made of granite. The popularity of granite is based on its surface properties, which provide a controlled detaching of the paper web from the rock face. Moreover, granite withstands the wearing effect of a doctor well.

However, granite has certain drawbacks. Being a natural material, its properties vary, and internal flaws in granite and its tendency of cracking constitute a serious obstacle for its use in some applications. Moreover, a granite roll is heavy, which increases the tendency of vibration of the structure. The weight of the rock roll is also reflected in the dimensioning of the lifting equipment and of the foundations of the paper machine.

In the prior art, synthetic rock rolls are known, which are, in principle, polymer-faced rolls in which rock powder, such as quartz sand, has been added to hard rubber or polyurethane. Drawbacks of these rolls have been excessive adherence of the paper web to the roll face as well as poor mechanical strength.

In the Applicant's Finnish Patent No. 70,273 a press roll is described whose surface layer is composed of a mixture of metal powder and an inorganic substance. The function of the metal is to act as a binder agent and to increase the toughness of the roll coating. The function of the inorganic substance is to provide a wear-resistant face of suitable surface energy, because the surface energy of the roll face must be within certain limits in order that the detaching of the paper web from the face of the press roll can be controlled.

In a roll in accordance with the Applicant's Finnish Pat. Appl. No. 853544 a suitable surface energy has been even better achieved, such that the metal component is stainless steel expressly containing chromium, the proportion of chromium in the metal being 9 to 35%. A stainless steel that contains an abundance of chromium is a hydrophilic material (chromium increases the hydrophily). On the other hand, by means of the alloying of chromium, wear-resistant chromium carbides were obtained in the structure. Chromium also increases the resistance of steel to corrosion. In such an "alloy", the ceramic material is separated from the steel itself as a chromium carbide.

In the Applicant's Finnish Patent Application No. 882006 a solution is described whose primary objective is to provide a roll and a method for the manufacture of the roll by means of which the detaching of the paper web from the roll face is controlled and the resistance of the roll to temperature and to mechanical strains is increased. With a view to achieving this objective, the roll in accordance with the FI Pat. Appl. 882006 is characterized in that the outer face of the roll coating consists of carbide-rich areas and of matrix areas placed between said areas.

SUMMARY OF THE INVENTION

Objects of the present invention are to provide a method for the manufacture of a roll as well as a roll manufactured by means of the method, by whose means the detaching of the paper web from the roll face can be optimized more readily than in the prior art and the long-term resistance of the roll to corrosion is more reliable.

With a view to achieving the objects stated above and those that will be explained hereinafter, the roll in accordance with the invention is mainly characterized in that the roll face is provided with a surface layer which protects the roll from wear and which provides good properties for detaching of the web, the surface layer being formed by thermal spraying of a powder wherein metal and ceramic phases are in the same powder particle, as well as with a dense layer for protection against corrosion, which layer is made of stainless steel whose chromium content is 10 to 29% and which layer is placed between the surface layer and the roll mantle, the function of this layer being to protect the roll mantle from corrosion and to promote the adhesion of the surface coating to the roll.

On the other hand, the method in accordance with the invention is mainly characterized in that, onto the roll face, a surface layer is formed which protects the roll from wear and which provides good properties for detaching of the web, this surface layer being formed by thermal spraying of a powder wherein metal and ceramic phases are in the same powder particle, as well as a dense layer for protection against corrosion, which layer is made of stainless steel whose chromium content is 10 to 29% and which layer is placed between the surface layer and the roll mantle, the function of this layer being to protect the roll mantle from corrosion and to promote the adhesion of the surface coating to the roll.

The ceramics present in the coating layer of the roll in accordance with the invention are tungsten, chromium, titanium, niobium, and boron carbides or mixed carbides of these carbides. The intermediate layer for protection from corrosion has been applied onto the roll by deposition welding or by lining the mantle with steel sheets. In order that a new surface coating can be made onto an existing layer for protection from corrosion that has been machined to its shape, the thickness of the layer for protection from corrosion must be at least 0.5 mm. The density of the layer for protection from corrosion is higher than 96% and, in view of providing and guaranteeing a necessary and adequate density, the layer for protection from the corrosion may be densified by means of laser, induction, plasma, flame, or electron-beam melting. In a roll in accordance with the invention, the microhardness of the surface coating layer is higher than 900 HV 0.3. Owing to the microhardness of the surface layer, the thickness of the surface coating may be thin, however at least 30 μm. The adhesion strength of the surface coating is higher than 50 MPa. The layer for protection from corrosion may be produced by means of thermal spraying. If necessary, an organic material, such as a fluoroplastic or a phenol resin, may be impregnated into the surface layer. The surface roughness of the surface layer is lower than Ra 5.2 μm. If necessary, there may be a separate adhesion layer between the surface layer and the layer for protection from corrosion.

By means of the invention, a number of significant advantages are obtained over the prior art solutions, of which advantages the following can be stated. The method in accordance with the invention makes the use of the rolls of the type of the invention more economical, because, when the surface coating of the roll is worn through, owing to its thick (more than 0.5 mm) layer for protection from corrosion, the roll can still be reground to its shape and thereupon be coated with a new surface coating.

Furthermore, it is possible to repair the dense (density higher than 96%) layer for protection from corrosion by welding. This property is necessary to achieve long service life of the roll, because, for example, in the press section of a paper machine, from time to time, damage and breakdowns occur in which the surface layer and the layer for protection from corrosion on a roll may be damaged. Moreover, compared with the prior art solutions, the roll in accordance with the present invention is clearly better, because in this roll type the perfect capability of the layer for protection from corrosion reduces the requirements to be imposed on the surface layer, whereby a greater freedom is allowed for optimization in view of detaching of the web and of wear resistance, for example, so that a certain and controlled porosity is allowed for the surface coating.

By applying the method in accordance with the invention, it is possible to employ roll bodies manufactured by the prior art casting technique, together with their ends and axle journals, by means of which said roll body the mechanical strength of the roll is mainly provided, whereas the surface properties and the strength of the surface of the roll are achieved in a novel way. Furthermore, instead of a cast mantle, it is possible to use a steel mantle.

The function of the surface coating is in particular to act as the press face of the roll, which has the special feature of good properties for detaching of the paper web.

The detaching properties are based on the properties of the carbide coating, which are microporosity, low friction, suitable roughness of the face, and preservation of these properties.

DESCRIPTION OF THE PREFERRED EMBODIMENTS

In the following, the construction, the chemical composition, and the other properties of the roll in accordance with the invention will be described in detail.

The roll coating in accordance with the invention consists of a metal-ceramic surface layer placed on the surface and of an underlying layer for protection from corrosion, whose thickness is at least 0.5 mm. In the construction in accordance with the invention it has been taken into account that in some cases the reliability of the construction can be improved by using a separate adhesion layer between the surface layer and the layer for protection from corrosion.

On a corresponding basis, the construction can be accomplished so that the compositions of the layer for protection from corrosion and of the surface layer are changed smoothly, i.e. there is no clearly defined boundary layer.

The surface coating of the roll in accordance with the invention has been formed by thermal spraying of a powder in which the metal and the ceramic phases are in the same powder particle. For the spraying it is possible to apply, for example, the spraying methods in accordance with the DIN standard No. 32,530 (October 1987).

For the spraying, it is possible to use powders whose particle size is 5 to 100 μm. In the preferred embodiment, the particle size is as small as possible, smaller than 45 μm, because in such a case the coating is very densely formed. The structure of the powder may be agglomerated, agglomerated and sintered, spheroidized, sintered and crushed, or prepared by the so-gel-method.

Preferred embodiments are chosen such that with low-energy coating methods powders of large specific surface area are used (e.g., agglomerated—sintered), because the specific surface area of these powders is large, which facilitates the transfer of energy to the particle to achieve good melting capacity.

In a corresponding way, in high-energy methods (e.g. plasma methods) powders of small specific surface area are used, because there is an abundance of energy required for the melting available.

From the point of view of the functioning of the surface coating it is preferable that the melt drops have been discharged onto the roll face at a velocity as high as possible, in which case the hardness of the surface coating becomes maximally high.

In a preferred embodiment the particles obtain a velocity which is higher than 300 m/s. In this way it is possible to achieve microhardnesses higher than 1300 HV. A high microhardness can be attained, e.g., by means of the carbides present in the coating, such as tungsten, chromium, titanium, niobium, and boron carbides and mixed carbides of these, and the proportion of these carbides in the coating may be up to 96%. The size of the carbides is typically 1 to 10 μm. Experiments that have been carried out have provided that, in view of the application, it is preferable that the carbides are as small as possible, preferably even smaller than 1 μm. Owing to their high microhardness, which is preferably higher than 900 HV 0.3, the surface coating does not necessarily have to be thick, because it has been ascertained that an adequate service life can already be attained with coatings of a few tens of micrometers.

The metal matrix of the surface coating is chosen such that its protection from corrosion is sufficient for paper machine conditions. Such matrixes as are adequate in view of corrosion are obtained by alloying of nickel, cobalt or iron or alloys of same with transition metals of the groups 4b . . . 6b in the periodic system of the elements. The surface roughness of the surface coating may be up to Ra 5.2 μm, even though, in a preferred embodiment, it is Ra 1 to 3 μm.

Between the surface coating and the central roll body, there is a layer for protection from corrosion, which is made of stainless steel and whose primary function is to protect the roll mantle from corrosion.

The thickness of the layer for protection from corrosion must be at least 0.5 mm in order that the same layer for protection from corrosion can be used again (as reground to its shape) below the next surface layer. In this way, substantial economies of cost are obtained. Also, in the invention advantage has been taken of the fact that in the press section damage occurs in which machine parts or tools pass through the press section, whereby the press rolls are damaged. In such a case, it may also be necessary to repair the layer for protection from corrosion. If the layer for protection from corrosion is sufficiently thick (more than 0.5 mm) and made of a material that can be welded readily (stainless steels), it is easy to repair the layer for protection from corrosion by welding.

In view of the need to protect from corrosion, it is essential that the layer for protection from corrosion has no open porosity, i.e. the porosity is less than 4%. A structure as dense as this can be achieved, e.g., by deposition welding or by using lining sheets. If an adhesion layer has been made by thermal spraying, it must be densified by means of laser, induction, plasma, flame, or electron-beam melting.

A capability to protect from corrosion which is adequate for the layer for protection from corrosion is attained by alloying at least 10% of chromium in the steel. Steel qualities that are suitable from the point of view of the capability to protect from corrosion are stated by way of example in the accompanying table.

TABLE steel qualities

| | COMPOSITION % | | | | | | | | |
|---|---|---|---|---|---|---|---|---|---|
| AISI Type | C | Mn max | P max | S max | Si max | Cr | Ni | Mo | Other |
| 201 | 0.15 max | 5.50 7.50 | 0.060 | 0.030 | 1.00 | 16.00 18.00 | 3.50 5.50 | | N 0.25 Max |
| 202 | 0.15 max | 7.50 10.00 | 0.060 | 0.030 | 1.00 | 17.00 19.00 | 4.00 6.00 | | N 0.25 Max |
| 301 | 0.15 max | 2.00 | 0.045 | 0.030 | 1.00 | 16.00 18.00 | 6.00 8.00 | | |
| 302 | 0.15 max | 2.00 | 0.045 | 0.030 | 1.00 | 17.00 19.00 | 8.00 10.00 | | |
| 302B | 0.15 max | 2.00 | 0.045 | 0.030 | 2.00 3.00 | 17.00 19.00 | 8.00 10.00 | | |
| 303 | 0.15 max | 2.00 | 0.20 | 0.15 min | 1.00 | 17.00 19.00 | 8.00 10.00 | 0.60 max | |
| 303Se | 0.15 | 2.00 | 0.20 | 0.060 | 1.00 | 17.00 | 8.00 | | SE 0.15 Min |
| 304 | 0.08 max | 2.00 | 0.045 | 0.030 | 1.00 | 18.00 20.00 | 8.00 12.00 | | |
| 304L | 0.030 max | 2.00 | 0.045 | 0.030 | 1.00 | 18.00 20.00 | 8.00 12.00 | | |
| 305 | 0.12 max | 2.00 | 0.045 | 0.030 | 1.00 | 17.00 19.00 | 10.00 13.00 | | |
| 308 | 0.08 max | 2.00 | 0.045 | 0.030 | 1.00 | 19.00 21.00 | 10.00 12.00 | | |
| 309 | 0.020 max | 2.00 | 0.045 | 0.030 | 1.00 | 22.00 24.00 | 12.00 15.00 | | |
| 309S | 0.08 max | 2.00 | 0.045 | 0.030 | 1.00 | 22.00 24.00 | 12.00 15.00 | | |
| 310 | 0.25 max | 2.00 | 0.045 | 0.030 | 1.50 | 24.00 26.00 | 19.00 22.00 | | |
| 310S | 0.08 max | 2.00 | 0.045 | 0.030 | 1.50 | 24.00 26.00 | 19.00 22.00 | | |
| 314 | 0.25 max | 2.00 | 0.045 | 0.030 | 1.50 3.00 | 23.00 26.00 | 19.00 22.00 | | |
| 316 | 0.08 max | 2.00 | 0.045 | 0.030 | 1.00 | 16.00 18.00 | 10.00 14.00 | 2.00 3.00 | |
| 316L | 0.030 max | 2.00 | 0.045 | 0.030 | 1.00 | 16.00 18.00 | 10.00 14.00 | 2.00 3.00 | |
| 317 | 0.08 max | 2.00 | 0.045 | 0.030 | 1.00 | 18.00 20.00 | 11.00 15.00 | 3.00 4.00 | |
| 321 | 0.08 max | 2.00 | 0.045 | 0.030 | 1.00 | 17.00 19.00 | 9.00 12.00 | | Ti, 5 × C min |
| 347 | 0.08 max | 2.00 | 0.045 | 0.030 | 1.00 | 17.00 19.00 | 9.00 13.00 | | Cb Ta, 10 × C |
| 348 | 0.08 max | 2.00 | 0.045 | 0.030 | 1.00 | 17.00 19.00 | 9.00 13.00 | | Cb Ta, 10 × C Ta, 0,10 max; CO, 0.20 max |
| 403 | 0.15 max | 1.00 | 00.40 | 0.030 | 0.50 | 11.5 13.0 | | | |
| 410 | 0.15 max | 1.00 | 0.040 | 0.030 | 1.00 | 11.5 13.5 | | | |
| 414 | 0.15 max | 1.00 | 0.040 | 0.030 | 1.00 | 11.5 13.5 | 1.25 2.50 | X | |
| 416 | 0.15 max | 1.25 | 0.060 | 0.15 Min | 1.00 | 12.0 14.0 | | 0.60 × max | |
| 416Se | 0.15 max | 1.25 | 0.060 | 0.060 | 1.00 | 12.0 14.0 | | | Se 0.15 min |
| 420 | 0.15 min | 1.00 | 0.040 | 0.030 | 1.00 | 12.0 14.0 | | | |
| 431 | 0.20 max | 1.00 | 0.040 | 0.030 | 1.00 | 15.0 17.0 | 1.25 2.50 | | |

TABLE-continued

| steel qualities | | | | | | | | | |
|---|---|---|---|---|---|---|---|---|---|
| 440A | 0.60<br>0.75 | 1.00 | 0.040 | 0.030 | 1.00 | 16.0<br>18.0 | | 0.75<br>max | |
| 440B | 0.75<br>0.95 | 1.00 | 0.040 | 0.030 | 1.00 | 16.0<br>18.0 | | 0.75<br>max | |
| 440C | 0.95<br>1.20 | 1.00 | 0.040 | 0.030 | 1.00 | 16.0<br>18.0 | | 0.75<br>max | |
| 403 | 0.15<br>max | 1.00 | 0.040 | 0.030 | 0.50 | 11.5<br>13.0 | | | |
| 410 | 0.15<br>max | 1.00 | 0.040 | 0.030 | 1.00 | 11.5<br>13.5 | | | |
| 414 | 0.15<br>max | 1.00 | 0.040 | 0.030 | 1.00 | 11.5<br>13.5 | 1.25<br>2.50 | X | |
| 416 | 0.15<br>max | 1.25 | 0.060 | 0.15<br>Min | 1.00 | 12.0<br>14.0 | | 0.60 ×<br>max | |
| 416Se | 0.15<br>max | 1.25 | 0.060 | 0.060 | 1.00 | 12.0<br>14.0 | | | Se<br>0.15<br>min |
| 420 | 0.15<br>min | 1.00 | 0.040 | 0.030 | 1.00 | 12.0 | 14.0 | | |
| 431 | 0.20<br>max | 1.00 | 0.040 | 0.030 | 1.00 | 15.0<br>17.0 | 1.25<br>2.50 | | |
| 440A | 0.60<br>0.75 | 1.00 | 0.040 | 0.030 | 1.00 | 16.0<br>18.0 | | 0.75<br>max | |
| 440B | 0.75<br>0.95 | 1.00 | 0.040 | 0.030 | 1.00 | 16.0<br>18.0 | | 0.75<br>max | |
| 440C | 0.95<br>1.20 | 1.00 | 0.040 | 0.030 | 1.00 | 16.0<br>18.0 | | 0.75<br>max | |

| | COMPOSITION, . . . % | | | | | | |
|---|---|---|---|---|---|---|---|
| AISI Type | C | Mn max | P max | S max | Si max | Cr | Other |
| 405 | 0.08 | 1.00 | 0.040 | 0.030 | 1.00 | 11.5<br>14.5 | 0.10<br>0.030 Al |
| | 430 | 0.12 | 1.00 | 0.040 | | | 18.0 |
| 430F | 0.12 | 1.25 | 0.060 | 0.15<br>min | 1.00 | 14.0<br>18.0 | 0.060 Mo |
| 430F-Se | 0.12 | 1.25 | 0.060 | 0.060 | 1.00 | 14.0 | 0.15 Se |
| 442 | 0.20 | 1.00 | 0.040 | 0.030 | 1.00 | 18.0<br>23.0 | min |
| 446 | 0.20 | 1.50 | 0.040 | 0.030 | 1.00 | 23.0<br>27.0 | 0.25 N<br>max |

In very demanding conditions the quantity of chromium (and nickel) alloying must be increased, whereby the composition is close to the so-called iron-based super alloys, such as SANICRO 28 of Sandvik (Cr 27, Mo 3.5, Ni 31.0, Fe bal). Compared with the self-melting Ni—Cr—B—Si and Ni—B—Si alloys, an iron-based layer for protection from corrosion is more economical, which circumstance is stressed in the present invention, because very large areas are concerned.

Compared with Mo-based adhesion layers, steel-based layers provide a better protection from corrosion and are tougher with fatiguing loads.

The roughness of the surface coating is regulated by means of the porosity of the coating, the size of the carbides, and the degree of finishing grinding. The porosity is affected by means of the coating parameters. With increased porosity the roughness of the surface is also increased. The size of the carbides is determined mainly by the carbide size in the powder of which the coating is formed. The carbide size can be reduced only a small amount by means of the coating parameters. When the carbide size becomes larger, the roughness of the surface also increases. The roughness of the surface is affected by means of the finishing grinding by grinding off the peaks of the carbides present in the surface, whereby the roughness of the surface is reduced, and the macroscopic unevenesses are also ground of at the same time. The roughness of the surface aimed at depends on the purpose of use; when the friction and detaching properties are to be increased, a higher roughness of the surface is chosen, such as $R_a$ 1 to 3.2 μm, and when low friction and low abrading quality are to be emphasized, the roughness of the surface is, e.g., $R_a$ 0.08 to 1 μm.

The hardness of the surface coating is higher than 900 HV 0.3, and its internal strength is higher than 50 MPa.

The coating of the roll in accordance with the invention is made of a powder, whose properties will be discussed briefly in the following.

With respect to its properties of moistening and surface tension, the coating is close to the same type of properties of granite, which has been used traditionally in the type roll concerned.

The long-term operating quality of the surface coating is ensured by the high wear resistance produced by the high hardness (900 HV) and by the good resistance to corrosion based on the alloying. Both of these factors retain the microporosity and surface roughness, which are essential to the detaching of the web. The original level of microporosity can be regulated by means of the parameters of the coating process.

Moreover, the invention will be illustrated by means of the following example.

A composite coating in accordance with the present application was prepared onto the center roll in the presses of the Applicant's test machine such that the cast-iron mantle was coated with a 10 mm thick mantle of AISI (Cr 17, Ni 12, bal Fe). The fixing of the mantle was carried out by shrinking-on. After shrinking, the roll was ground to its shape and coated by thermal spraying with a Co + WC coating of thickness of 0.09 mm. The web detaching properties of such a roll are similar to those illustrated in FIG. 1 in the Applicant's Finnish pat. Appl. 882006. The tension of the shrunk-on layer for protection from corrosion was measured to be higher than 250 MPa, which exceeds the requirement imposed on it.

In the following, the patent claims will be given, and the details may show variation within the scope of the inventive idea defined in these claims.

What is claimed is:

1. A method for the manufacture of a roll used in a paper making machine, said method comprising the steps of:

forming on a center roll body mantle a corrosion protection layer; and forming a surface layer on said corrosion protection layer by thermal spraying of powder particles wherein metal and ceramic phases are in each powder particle.

2. The method of claim 1, further comprising forming said corrosion protection layer by deposition welding.

3. The method of claim 1, further comprising forming said corrosion protection layer by lining said mantle with steel sheets.

4. The method of claim 1, further comprising machining said corrosion protection layer into an appropriate shape before forming said surface layer thereon.

5. The method of claim 1, further comprising forming said corrosion protection layer by thermal spraying.

6. The method of claim 1, further comprising densifying said corrosion protection layer by melting.

7. The method of claim 6, wherein said melting is laser, induction, plasma, flame or electron beam melting.

8. The method of claim 1, further comprising impregnating a fluoroplastic into said surface layer.

9. The method of claim 1, further comprising impregnating a phenol resin into said surface layer.

10. The method of claim 1, further comprising forming a separate adhesive layer between said surface layer and said corrosion protection layer.

11. The method of claim 1, further comprising forming said corrosion protection layer by using stainless steel having a chromium content of 10 to 29%.

12. The method of claim 1, further comprising the steps of providing said ceramic phase with sufficient amount of carbides having a suitably small particle size such that a surface layer having a microhardness greater than about 900 HV 0.3 is achieved, and providing said corrosion protection layer with a sufficient thickness such that it is reweldable when the surface layer is worn through.

13. The method of claim 1, further comprising the step of providing said corrosion protection layer with an open porosity having a surface area of less than about 4% of the surface area of said corrosion protection layer.

14. The method of claim 1, wherein the ceramic phase of said surface layer is selected from carbides selected from the group consisting of tungsten, chromium, titanium, niobium, boron, and a mixture of any of the foregoing carbides.

15. The method of claim 1, wherein the metal phase of said surface layer is a metallic matrix obtained by alloying a metal selected from the group consisting of nickel, cobalt, iron and alloys of any of the foregoing, with a transition metal selected from the group consisting of group 4b, group 5b, group 6b of the periodic system of the elements, and mixtures of any of the foregoing.

16. The method of claim 1, wherein the ceramic phase of each particle has a size of about 1 to about 10 μm.

17. The method of claim 1, further comprising the step of forming the powder particles by agglomeration.

18. The method of claim 1, further comprising the step of forming the powder particles by agglomeration and sintering.

19. The method of claim 1, further comprising the step of forming the powder particles by spheroidizing, sintering and crushing.

20. The method of claim 1, further comprising the step of forming the powder particles by the so-gel-method.

* * * * *